US008728305B2

(12) United States Patent
Stokes et al.

(10) Patent No.: US 8,728,305 B2
(45) **Date of Patent: *May 20, 2014**

(54) SYSTEMS AND METHODS FOR OIL SANDS PROCESSING

(75) Inventors: Kristoffer K. Stokes, Jamaica Plain, MA (US); David Soane, Chestnut Hill, MA (US)

(73) Assignee: Soane Energy, LLC, Cambridge, MA (US)

( * ) Notice: Subject to any disclaimer, the term of this patent is extended or adjusted under 35 U.S.C. 154(b) by 458 days.

This patent is subject to a terminal disclaimer.

(21) Appl. No.: 12/775,190

(22) Filed: May 6, 2010

(65) Prior Publication Data

US 2011/0114539 A1 May 19, 2011

Related U.S. Application Data

(63) Continuation of application No. PCT/US2008/082653, filed on Nov. 6, 2008.

(60) Provisional application No. 60/986,801, filed on Nov. 9, 2007.

(51) Int. Cl.
*C10G 1/04* (2006.01)

(52) U.S. Cl.
USPC ..... 208/390; 208/391

(58) Field of Classification Search
CPC ..... C10G 1/00; C10G 1/04; C10G 1/047; C10G 2300/4006
USPC ..... 208/390, 391
See application file for complete search history.

(56) References Cited

U.S. PATENT DOCUMENTS

| | | | | |
|---|---|---|---|---|
| 3,107,726 | A | 10/1963 | Greenwald | |
| 3,519,581 | A * | 7/1970 | Dougherty et al. | 527/401 |
| 3,857,830 | A * | 12/1974 | Briggs | 527/401 |
| 3,956,261 | A | 5/1976 | Lin | |
| 4,296,812 | A | 10/1981 | Kalfoglou | |
| 4,391,925 | A * | 7/1983 | Mintz et al. | 523/130 |
| 4,405,446 | A * | 9/1983 | Kruyer | 208/390 |
| 4,739,041 | A | 4/1988 | Morrow et al. | |
| 4,946,597 | A * | 8/1990 | Sury | 208/390 |
| 5,200,096 | A | 4/1993 | Williams et al. | |
| 5,215,596 | A | 6/1993 | Van Slyke | |
| 5,274,014 | A * | 12/1993 | Silverton | 524/60 |
| 5,406,019 | A | 4/1995 | Dean | |
| 5,482,118 | A * | 1/1996 | Clough | 208/264 |
| 6,172,204 | B1 | 1/2001 | Sarkanen et al. | |
| 6,484,441 | B1 | 11/2002 | Hüttermann et al. | |
| 6,593,506 | B1 | 7/2003 | Searle | |
| 6,772,838 | B2 | 8/2004 | Dawson et al. | |
| 7,122,112 | B2 | 10/2006 | Mukkamala et al. | |
| 7,871,963 | B2 | 1/2011 | Stokes et al. | |
| 2005/0038128 | A1 | 2/2005 | Argillier et al. | |
| 2005/0093361 | A1 | 5/2005 | Drake et al. | |
| 2006/0149109 | A1 | 7/2006 | Ruziska et al. | |
| 2006/0276345 | A1 | 12/2006 | Todd et al. | |
| 2007/0209971 | A1 * | 9/2007 | Duyvesteyn et al. | 208/391 |
| 2008/0249339 | A1 | 10/2008 | Stokes et al. | |

FOREIGN PATENT DOCUMENTS

| | | | |
|---|---|---|---|
| EP | 261793 | * | 3/1988 |
| RU | 2265473 | C1 | 12/2005 |
| WO | 87/02376 | A1 | 4/1987 |
| WO | 03/093357 | A1 | 11/2003 |

OTHER PUBLICATIONS

U.S. Appl. No. 12/968,671, Stokes et al.

Bujanovic, B., et al., "Studies of lignin transformation in polyoxometalate (POM) bleaching of kraft pulp," 2005, abstract (online), retrieved on Dec. 17, 2008 from the inlernet at <URL:hltp://www.treesearch.fs.fed.us/pubs/23118>.

* cited by examiner

*Primary Examiner* — Randy Boyer
*Assistant Examiner* — Michelle Stein
(74) *Attorney, Agent, or Firm* — Elmore Patent Law Group, P.C.; Mahreen Chaudhry Hoda; Carolyn S. Elmore, Esq.

(57) ABSTRACT

The systems and methods described herein provide for extracting bitumen from oil sands at ambient or subambient temperature, for example at temperatures between 0 degrees Centigrade and about 20 degrees Centigrade. The process includes the steps of forming a slurry by mixing the oil sands with water, adding an extractant to the slurry, agitating the extractant with the slurry, and collecting bitumen that separates from the slurry.

25 Claims, No Drawings

SYSTEMS AND METHODS FOR OIL SANDS PROCESSING

RELATED APPLICATIONS

This application is a continuation of International Application No. PCT/US2008/082653, which designated the United States and was filed on Nov. 6, 2008, published in English, which claims the benefit of U.S. Provisional Application No. 60/986,801, filed on Nov. 9, 2007. The entire teachings of the above applications are incorporated herein by reference.

FIELD OF APPLICATION

This application relates generally to extraction of bitumen from mined oil sands.

BACKGROUND

Extracting bitumen from mined oil sands offers the possibility of addressing future needs for energy. Present-day methods for separating the bitumen from the inorganic species in oil sands are inefficient and costly, however. A major inefficiency arises from the need to use heat for bitumen extraction. Providing the needed heat is itself expensive and requires energy. Furthermore, heat provided in the form of hot water for extraction is lost to the environment as hot water run-off after its exposure to the oil sands. The hot water run-off contains non-recyclable heat energy that adds additional stresses to the environment.

Presently, the bituminous ore mined from the oil sands ore is crushed and mixed with water heated to 55° C. to "condition" the ore for separation. This temperature is far in excess of the ambient temperature in the environment. The mixture thus prepared, also called a "slurry," may be alkalinized by the addition of a strong caustic agent, typically sodium hydroxide. The slurry is then pumped through a hydrotransport pipeline, where mechanical turbulence further assists with separating bitumen from the inorganic sands. The two to three kilometer long hydrotransport pipelines conduct the slurry to processing facilities. When received in a processing facility, the separated slurry is aerated and sent to a gravity separation vessel. Spent sands are ejected from the bottom of the gravity separator. Meanwhile, the aerated bitumen floats to the top and is removed for further froth treatment and upgrading to synthetic crude oil.

There has been a decrease in the temperature requirements over the years from the original Clark hot water process that required a water temperature of 85° C. to the present-day processes that use water temperatures of approximately 55° C. Nonetheless, a considerable amount of energy is required to heat the water used in processing the mined oil sands and extracting the bitumen there from. In the procedure described above, the oil sands slurry being processed contains about 20-30% oil sands by weight, with the rest of the processed volume (about 70-80%) being water. A significant amount of energy is required to maintain the slurry water temperature at this level.

Hot water extraction is particularly difficult in a northern latitude location like the Athabasca oil sand field. The climate in northern Alberta ensures that oil sands mining and subsequent bitumen extraction must be carried out in cold temperatures for much of the year. Edmonton, Alberta, for example, has a mean January temperature of −11.7° C., and an average of 178.6 days per year with a temperature less than 0° C. The average annual snowfall is 123.5 cm. In January, 1911, a record low temperature of −61.1° C. was reported. The mean July temperature is 17.5° C. (Preceding data obtained from *The Canadian Encyclopedia*, online edition at http://www.thecanadianencyclopedia.com/index.cfm?PgNm=TCE&Params=A1SEC89 2428). This environment makes heat processing of oil sands for bitumen extraction more difficult and less efficient, especially in view of the long exposure of the slurry to cold temperatures while in transit within the hydrotransport pipelines.

Oil sands processing facilities have recognized that a lower-temperature separation technology could lower the cost of bitumen extraction. A number of technologies have offered methods for lowering the required extraction method, for example, U.S. Pat. Nos. 4,425,227 and 4,946,597. There remains a need in the art, however, for lower-temperature extraction methods, including those that can be conducted at ambient or subambient temperatures.

SUMMARY

In embodiments, systems and methods are disclosed herein for extraction of bitumen from oil sands at temperatures, following the steps of forming a slurry by mixing the oil sands with water (or other suitable liquid system), adding an extractant to the slurry, agitating the extractant with the slurry, and collecting bitumen that separates from the slurry, wherein the slurry is maintained at a temperature between about 0 degrees Centigrade and about 25 degrees Centigrade. The extractant is preferably a polyalkylene oxide derived lignin, such as the reaction product of a lignin, optionally alkylated acid or acid derivative, such as a succinic acid anhydride, and a polyalkylene oxide, such as polypropylene oxide diglycidyl ether or polyethylene oxide diglycidyl ether. In embodiments, the temperature for these processes may be ambient (defined herein to be between about 20 and 25 degrees Centigrade) or subambient. In a preferred embodiment, the temperature is ambient and the preferred polyalkylene oxide is a polypropylene oxide, e.g., as polypropylene oxide diglycidyl ether. In another preferred embodiment, the temperature is subambient (defined herein to be between about 0 and 20, preferably between about 0 and 5, degrees Centigrade) and the preferred polyalkylene oxide is a polyethylene oxide, e.g., as polyethylene oxide diglycidyl ether.

In embodiments, systems and methods are disclosed herein for extraction of bitumen from oil sands, following the steps of forming a slurry by mixing the oil sands with water or other suitable liquid system, the slurry being formed at ambient temperature, adding an extractant to the slurry, the extractant comprising lignin, alkylated succinic anhydride and polyethylene oxide diglycidyl ether, agitating the extractant with the slurry at subambient temperature, and collecting bitumen that separates from the slurry.

In embodiments, systems and methods are disclosed herein for extraction of bitumen from oil sands at a temperature that may be ambient, subambient, or supra-ambient. In an embodiment, a system may include a transport pipeline carrying a slurry of oil sands mixed with water or other liquid system, the slurry being treated with an extractant, an aerator that infuses the slurry with pressurized gas, such as air, to produce an aerated froth bearing bitumen, and a separation vessel wherein aerated froth bearing bitumen may be separated from residual slurry.

DETAILED DESCRIPTION

In embodiments, the systems and methods disclosed herein relate to the processes for extracting bitumen from the transported water slurry. In the conditioning slurry, the oil sands concentration can be as high as 70% by weight, though it is typically diluted to 20-30% prior to flotation and transport. Here, a mixture of our extractant in water can be used to great effect on the extraction of bitumen from oil sands. Utilizing modified waste lignin from the paper industry, an inexpensive material can be created with minor additions from commodity chemicals and polymers. This material can be used in conjunction with standard, elevated-temperature extraction processes (i.e., at supra-ambient temperatures) to facilitate the removal of bitumen from the transported water slurry. Moreover, this material decreases the temperature required for bitumen removal from 55° C. to 25° C. or lower, and using polyalkylene oxide as a modification, can decrease the requisite temperature even further.

The extractant used herein can be made in accordance with the teachings in U.S. Ser. No. 11/850,749, which is incorporated herein by reference in its entirety. Preferably, the surfactant is a derivatized lignin, such as can be produced by reacting a lignin with an acid or derivative thereof (e.g., anhydride), such as a succinic anhydride or alkylated succinic anhydride. Preferred lignin includes kraft lignin characterized by hydroxyl groups. In one embodiment, between about 50 and 100% of the lignin hydroxyl groups are functionalized. The lignin is preferably further derivatized with a hydrophilic polymer substituent, such as a polyethylene oxide and a polypropylene oxide, including a polyethylene oxide diglycidyl ether and a polypropylene oxide diglycidyl ether. The hydrophilic polymer substituent preferably has a molecular weight between about 700 and 2500 g/mol. The surfactant can also be characterized by an inert substituent, such as a silicone, a siloxane, and a perfluorinated polymer, for example, added in an amount less than 25% by weight to the surfactant.

Lignin is a natural polymer which can be isolated from wood and wood products and is characterized by a hydrophobic backbone and hydroxyl groups, useful for further modification. Lignin and oxidized lignin are waste products from the paper industry. Oxidized lignin is described, for example, in U.S. Pat. No. 4,790,382 and is characterized by a plurality of hydroxyl groups which can be conveniently reacted. Similarly, kraft lignins, such as indulins, including INDULIN AT®, can be used to produce the petroleum recovery media of the invention. For example, the hydroxyl groups of such lignins can be reacted with an anhydride, such as succinic anhydride, and similar compounds to form a carboxylic acid-substituted lignin, by a ring opening reaction.

Lignin is a naturally-occurring polymer comprised of aliphatic and aromatic portions with alcohol functionality interspersed. Lignin polymers incorporate three monolignol monomers, methoxylated to various degrees: p-coumaryl alcohol, coniferyl alcohol, and sinapyl alcohol. These are incorporated into lignin in the form of the phenylpropanoids, p-hydroxyphenyl, guaiacyl, and syringal respectively. The systems and methods disclosed herein describe how naturally-occurring (i.e., native) and unnatural or modified lignin may be modified through functionalization of the resident alcohol moieties to alter the properties of the polymer, so that it may be adapted for petroleum recovery. Such a functionalized lignin may be termed a "modified lignin." The word "lignin", as used herein is intended to include natural and non-natural lignins which possess a plurality of lignin monomers and is intended to embrace lignin, kraft lignin, lignin isolated from bagasse and pulp, oxidized lignin, alkylated lignin, demethoxylated lignin, lignin oligomers, and the like.

Because lignin's chemical structure has similarity to the aromatic compounds found abundantly in heavy crude and tar sand, its modification and use as a tunable surfactant may be particularly effective in emulsifying such materials in petroleum recovery, for example as compared with generic surfactants such as sodium dodecyl sulfate (SDS) or ordinary soaps based on aliphatic tails. Other hydrophobic backbones which can be used to create the surfactants of the invention include complex aromatic hydrocarbon structures, such as polymerized tannins In alternative embodiments, polysaccharides, such as cellulose can be used. Hydroxylated polystyrenes can be used as well.

Preferably, the lignin is derivatized with an acid or acid derivative such as succinic anhydride or alkylated succinic anhydride. Alkylated succinic anhydride is commonly used in the paper industry as a sizing agent. The alkyl additions are preferably long chain hydrocarbons typically containing 16-18 carbon atoms. However, alkylated succinic acids having alkyl side chains having more than 1 carbon atom, such as 1 to 30 carbon atoms can be used as well. Such alkyl groups are defined herein to include straight chain, branched chain or cyclized alkyls as well as saturated and unsaturated alkyls. Examples of alkylated succinic anhydride include EKA ASA 200® (a mixture of C16 and C18 ASA) and EKA ASA 210® (a C18 ASA). Addition of an anhydride, such as a succinic anhydride or alkylated succinic anhydride to the resident alcohol groups result in new ester linkages and the formation of carboxylic acids via a ring opening mechanism.

In embodiments, addition of alkylated succinic anhydride to the resident alcohol groups in lignins may result in a new ester linkage and a carboxylic acid via a ring opening mechanism. With the newly added carboxylic acid functionality, the lignin becomes more water soluble. The incorporation of the alkane functionalities also imbues the compound with enhanced compatibility with lower molecular weight alkanes also present within the bitumen. By varying the composition of these additions, lignin can be adapted for a wide variety of bitumen compositions and inorganic components.

In other embodiments, the hydroxyl group resident on the hydrophobic polymer, or lignin, can be reacted with a dicarboxylic acid, such as maleic acid, or activated esters or anhydrides thereof to form a carboxylic acid substituted lignin. For example, the anhydride derived from many acids can be utilized, such as adipic acid. Further, activated esters can be used in place of the anhydride. Other examples will be apparent to those of ordinary skill in the art.

The degree of functionalization of the lignin (i.e., the percentage of hydroxyl groups that are reacted to present an ionic moiety) can be between 50% and 100%, preferably between 80% and 100% on a molar basis of the hydroxyl groups found on native lignins or a kraft lignin, such as INDULIN AT®.

Where the ionizable functional group is a cation or amine, the group can be attached to the hydrophobic backbone by chemical methods generally known in the art. For example, the amine could be added to a lignin via a coupling agent, such as silane or diepoxide with a second subsequent reaction with a diamine or polyamine.

In other embodiments, lignin (oxidized or native) may be treated by chemically reacting it with reagents to tune the hydrophilicity to present alcohol groups. Examples of such reagents include hydrophilic molecules, or hydrophilic polymers, such as poly(ethylene glycol) (PEG) or polypropylene glycol) (PPO) and combinations thereof. In a preferred embodiment, the hydrophilic polymer can have a molecular weight between 700 and 2500 g/mol Addition of PEG or PPO (with or without acidification) can be useful in stabilization of the product in salt solutions, particularly divalent cation salts. In this embodiment, the amount of polymer to lignin is preferably added in an amount between 25% and 75%.

Other embodiments may include the chemical reaction of an inert component to prevent the compound from adsorbing or attracting to other materials within the oil formation, such as the rock. In this embodiment, silicones, siloxanes, such as poly(dimethylsiloxane) (PDMS), perfluorinated polymers (such as TEFLON®), polystyrenes or other hydrophobic polymers to increase the hydrophobicity of the lignin surfactant. Increasing the hydrophobicity of the surfactant can result in the reduction of surfactant loss within an oil formation comprising hydrophilic rock or geologies. Thus, grafting such hydrophobic polymers, such as PDMS, onto the lignin structure can be done, for example, to change the interaction of the surfactant with various petroleum and rock variations. The selection of the hydrophobic polymer and the amount thereof to be grafted can be determined empirically to adapt the surfactant to geologies that demonstrate high retention of the surfactant. By adding these chains, adsorption can be limited and the active concentration of surfactant to remain high. For example, PDMS can preferably be added to the lignin polymer in an amount between about 0 and 25% by weight.

It is desirable to control the molecular weight of the extractant. Molecular weight ranges are preferably between about 500 and 3000, preferably about 1000 MW.

The extractant used herein is adaptable to the current infrastructure. Extractant addition in the current conditioning step may facilitate immediate separation of the bitumen from the slurry. Concentrations of about 200-10000 ppm of the extractant in water may be advantageous, in view of the desire to strike a balance between cost and extraction efficiency.

After transport through the pipeline to the gravity separation vessel, the aerated bituminous froth may be skimmed from the top. This froth, containing a composition of water, bitumen, residual sand and clay as well as a portion of the added extractant, may require further separation and treatment.

Further treatment of the froth would occur, to remove residual water and solids. Having been diluted with compatible solvents for transport purposes, for example, the froth may be delivered to an upgrading facility. Here, the froth may be cracked, broken down, and/or reformed to create a synthetic crude oil having a much lower viscosity than the bitumen feedstock. Such synthetic crude oil may be sent downstream for further refining. Carryover of this extractant to these further processing steps should not affect them detrimentally. The extractant may be primarily carbon, hydrogen, and oxygen, so that it contains no unwanted nitrogen and sulfur components that may hinder the upgrading process.

In addition to its use in the bitumen separation and frothing process, the extractant may have other application where water-borne stripping of bitumen may be employed. For example, the extractant may have uses as a detergent, for example to clean the equipment used in oil sands operations, whether at elevated, ambient or subambient temperatures. A dilute solution of the extractant at elevated, ambient or subambient temperatures may be useful for washing trucks, shovels, and other machinery involved in the mining process to remove residual tar-like bitumen that frequently coats the parts and decreases mining efficiency. Further uses within other industrial sectors that frequently deal with heavy crude oils may be readily envisioned by those having ordinary skill in the arts.

EXAMPLES

Example 1

INDULIN AT® (5.0 g) is mixed with 4.0 g Eka SA 210 and 1.0 g polyethylene glycol diglycidyl ether in a bomb filled with 150 ml of acetone. The mixture is heated to 70° C. over 48 hours. The resulting mixture is filtered; the supernatant is recovered and diluted with alkaline water to create an active product.

Example 2

INDULIN AT® (5.0 g) is mixed with 3.0 g Eka SA 210 and 1.0 g polypropylene oxide diglycidyl ether in a bomb filled with 150 ml of acetone. The mixture is heated to 70° C. over 48 hours. The resulting mixture is filtered; the supernatant is recovered and diluted with alkaline water to create an active product.

Example 3

Oil sands obtained from the core sample bank at the Alberta Research Council were used for all experiments. Typical bitumen content was approximately 10% by weight. The extractant samples were synthesized as described in Examples 1 and 2.

A measured amount of oil sands was added to a beaker and a slurry prepared by addition of 120 of a 0.5% solution of water and extractant. The extractant solution was prepared in advance by dissolving a known amount in water and slowly adding a concentrated sodium hydroxide solution until the extractant is completely dissolved. The pH of the resulting solution is recorded, and the extraction is performed.

Extraction is accomplished by stirring the slurry at approximately 400 rpm on a magnetic stirrer. The temperature is controlled as described, either at ambient temperature (20° C.) or at sub-ambient temperature (5° C.). Air was injected via a needle at a rate of approximately 10-20 ml per minute. After floatation, the bitumen froth is collected by skimming from the surface. The collected froth is dried in an oven overnight, followed by pyrolysis. The difference in mass pre- and post-pyrolysis provides the basis for calculation of the bitumen to solid ratio.

Table 1 demonstrates the efficacy of the alkylated succinic anhydride (ASA) and polypropylene oxide) (PPO) modified lignins at 20° C.

TABLE 1

Extraction results from 50:50 ASA:PPO lignin extractant (20° C.)

| Test pH | Oil Sand sample size (g) | Total Mass Recovered (g) | Pyrolyzed Bitumen (g) | Residual Ash (g) | Extracted Bitumen Fraction |
|---|---|---|---|---|---|
| 11 | 24.0 | 3.620 | 2.025 | 1.595 | 0.55 |
| 11 | 24.0 | 4.347 | 2.442 | 1.905 | 0.56 |
| 8 | 20.0 | 2.718 | 1.210 | 1.508 | 0.44 |
| 10 | 20.0 | 2.282 | 1.232 | 1.047 | 0.53 |

Tables 2 and 3 depict the efficacy of an ASA and poly(ethylene oxide) (PEO) modified lignin extractants. The control refers to the current hot water process of hot water and caustic mixed with oil sands, tested on our apparatus.

TABLE 2

Extraction results from various compositions of ASA:PEO (X:Y) lignin extractant (20° C., pH 11).

| Extractant Composition (ASA:PEO) | Oil Sand Sample Size (g) | Total Mass Recovered (g) | Pyrolyzed Bitumen (g) | Residual Ash (g) | Extracted Bitumen Fraction |
|---|---|---|---|---|---|
| 50:50 | 20.00 | 1.48 | 0.92 | 0.56 | 0.62 |
| 60:40 | 20.00 | 1.38 | 0.91 | 0.47 | 0.65 |
| 75:25 | 20.00 | 1.17 | 0.76 | 0.41 | 0.64 |
| 90:10 | 20.00 | 0.61 | 0.36 | 0.25 | 0.59 |
| 100:0 | 20.00 | 0.83 | 0.51 | 0.31 | 0.62 |
| Control 55 C. | 20.00 | 1.17 | 0.78 | 0.39 | 0.66 |

Control refers to conventional extraction at 55° C., pH 11

TABLE 3

Extraction results from various compositions of ASA:PEO (X:Y) lignin extractant (5° C., pH 11).

| Extractant Composition (ASA:PEO) | Oil Sand Sample Size (g) | Total Mass Recovered (g) | Pyrolyzed Bitumen (g) | Residual Ash (g) | Extracted Bitumen Fraction |
|---|---|---|---|---|---|
| 50:50 | 20.00 | 2.22 | 1.05 | 1.16 | 0.47 |
| 60:40 | 20.00 | 2.54 | 1.41 | 1.12 | 0.55 |
| 75:25 | 20.00 | 1.51 | 1.05 | 0.46 | 0.69 |
| 90:10 | 20.00 | 1.49 | 1.06 | 0.43 | 0.71 |
| 100:0 | 20.00 | 1.45 | 0.91 | 0.54 | 0.62 |
| Control 55 C. | 20.00 | 1.17 | 0.78 | 0.39 | 0.66 |

Control refers to conventional extraction at 55° C., pH 11

EQUIVALENTS

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that may vary depending upon the desired properties sought to be obtained by the present invention.

What is claimed is:

1. A method for extraction of bitumen from oil sands, comprising:

forming a slurry by mixing the oil sands with a liquid, adding an extractant to the slurry, wherein the extractant comprises the reaction product of a lignin, alkylated succinic anhydride and a hydrophilic polymer, agitating the extractant with the slurry, and collecting bitumen that separates from the slurry.

2. The method of claim 1, wherein the slurry is maintained at a temperature between about 0 degrees Centigrade and about 25 degrees Centigrade.

3. The method of claim 1, wherein the lignin is a kraft lignin characterized by hydroxyl groups.

4. The method of claim 1, wherein the lignin is an indulin.

5. The method of claim 3, wherein 50 and 100% of the lignin hydroxyl groups are functionalized.

6. The method of claim 3, wherein 80 and 100% of the lignin hydroxyl groups are functionalized.

7. The method of claim 1, wherein the hydrophilic polymer is a polyalkylene oxide.

8. The method of claim 1, wherein the hydrophilic polymer is a polypropylene oxide diglycidyl ether or polyethylene oxide diglycidyl ether.

9. The method of claim 8, wherein the hydrophilic polymer substituent has a molecular weight between about 700 and 2500 g/mol.

10. The method of claim 9, wherein the amount of polymer reacted with lignin is in an amount between 25% and 75% by weight.

11. The method of claim 1, wherein the oil sands concentration in the slurry is less than 70% by weight.

12. The method of claim 1, further comprising the step of diluting the oil sands concentration to 20-30% by weight.

13. The method of claim 1, wherein the extractant is added at 200-10000 ppm of water.

14. A method for extraction of bitumen from oil sands, comprising:

forming a slurry by mixing the oil sands with a liquid, the slurry being formed at a temperature lower than about 25 degrees Centigrade, adding an extractant to the slurry, agitating the extractant with the slurry, and collecting bitumen that separates from the slurry, wherein the extractant comprises the reaction product of a lignin, alkylated succinic anhydride and a hydrophilic polymer.

15. The method of claim 14, wherein the lignin is a kraft lignin characterized by hydroxyl groups.

16. The method of claim 14, wherein the lignin is an indulin.

17. The method of claim 16, wherein 50 and 100% of the lignin hydroxyl groups are functionalized.

18. The method of claim 17, wherein 80 and 100% of the lignin hydroxyl groups are functionalized.

19. The method of claim 14, wherein the hydrophilic polymer is a polyalkylene oxide.

20. The method of claim 14, wherein the hydrophilic polymer is a polyethylene oxide diglycidyl ether.

21. The method of claim 20, wherein the hydrophilic polymer substituent has a molecular weight between about 700 and 2500 g/mol.

22. The method of claim 14, wherein the amount of polymer reacted with lignin is in an amount between 25% and 75% by weight.

23. The method of claim 14, wherein the oil sands concentration in the slurry is less than 70% by weight.

24. The method of claim 14, further comprising the step of diluting the oil sands concentration to 20-30% by weight.

25. The method of claim 14, wherein the extractant is added at 200-10000 ppm of water.

* * * * *